US006004106A

United States Patent [19]

Machida et al.

[11] Patent Number: 6,004,106

[45] Date of Patent: Dec. 21, 1999

[54] DISTRIBUTOR TYPE FUEL INJECTION PUMP AND POWER TRANSMISSION DEVICE

[75] Inventors: Hajime Machida; Satoshi Kitamura; Jun Matsubara, all of Higashimatsuyama, Japan

[73] Assignee: Zexel Corporation, Tokyo, Japan

[21] Appl. No.: 09/019,928

[22] Filed: Feb. 6, 1998

[30] Foreign Application Priority Data

Feb. 7, 1997 [JP] Japan ..... 9-039885

[51] Int. Cl.[6] ..... F04B 49/00; F02M 41/00

[52] U.S. Cl. ..... 417/223; 123/450; 123/449

[58] Field of Search ..... 417/223, 319, 417/462, 488; 123/449, 450

[56] References Cited

U.S. PATENT DOCUMENTS 5,085,195 2/1992 Yoshizu ..... 123/502
5,513,965 5/1996 Nakamura et al. ..... 417/462
5,619,971 4/1997 Kubo et al. ..... 123/450
5,641,274 6/1997 Kubo et al. ..... 417/206
5,806,493 9/1998 Kubo et al. ..... 123/450

*Primary Examiner*—John A. Jeffery
*Assistant Examiner*—Vinod D Patel
*Attorney, Agent, or Firm*—Wenderoth, Lind & Ponack, L.L.P.

[57] ABSTRACT

In a distributor type fuel injection pump and a power transmission pump for transmitting power to the fuel injection pump, when a rotation system member of the injection pump is seized if anything should happen, only an injection pump is damaged to thereby greatly reduce damage to an engine. To this end, an annular groove is provided in a rotor to which power from the engine is transmitted, and the annular groove constitutes a frail portion of the rotor. The annular groove is positioned along the rotor so that all or most of the sliding portions of the rotor are located on a side of the groove opposite to a power supply side. When seizure occurs in the sliding portions of the rotor to prevent rotation, the rotor is twisted off at the annular groove by the power from the engine, so that rotation of a power supply side portion of the rotor is not prevented.

13 Claims, 3 Drawing Sheets

DISTRIBUTOR TYPE FUEL INJECTION PUMP AND POWER TRANSMISSION DEVICE

BACKGROUND OF THE INVENTION

This invention relates to a distributor type fuel injection pump for supplying fuel to an engine, especially a distributor type fuel injection pump (an inner cam system fuel injection pump) in which plungers are provided slid ably in radial direction in a rotor rotating synchronously with an engine, and the plungers are made to reciprocate by moving on a cam surface of a cam ring to vary the volume of a compression space formed in the rotor.

An inner cam system distributor type fuel injection pump is, for instance, as shown in Unexamined Patent Publication No. S59-119056, Unexamined Patent Publication No. S60-79152, Unexamined Patent Publication No. H3-175143 and so on, constructed such that an inner cam (a cam ring) is located around a fuel distributing rotation member (a rotor), compressing plungers are engaged on a cam surface formed inside of the inner cam via a rolling member, etc., and the compressing plungers are made to reciprocate in radial directions of the fuel distributing rotation member. The fuel distributing rotation member is provided with a pump chamber (a compression space) whose volume is varied by the compressing plungers, an intake hole for inhaling fuel into the pump chamber in an intake process, a distributing port for delivering fuel compressed in the pump chamber in a delivery process, and an over-flow port for cutting off delivery of fuel. A ring-shaped member (a control sleeve) is fitted outside of the fuel distributing rotation member so as to cover the over-flow port, and cut-off timing in the delivery process is varied by moving the ring-shaped member in the axial direction, so that injection quantity may be varied.

A system of power transmission for supplying rotation power to the rotation member of this injection pump is constituted such that drive pulleys mounted on a crank shaft of the engine, a cam shaft for an intake/discharge valve, and a drive shaft of the injection pump are connected by a timing belt, the timing belt is given a specific tension to reliably supply drive power of the engine to the drive shaft of the injection pump and to maintain timing of operation between pistons of the engine and the intake/discharge valve in good condition.

By the way, in the fuel injection pump, for increasing performance of injection, a small tolerance is required for a clearance between the rotation member and the members with respect to which the rotation member slides. In lubrication in this sliding portion, fuel which is to be compressed is used as a lubricating oil, so that fuel with impurities sufficiently removed is used. Though this is managed sufficiently, if fine foreign matter flows into the fuel injection and enters into the sliding portion of the rotation member, the sliding portion of the rotation member is damaged, so that smooth sliding is lost and then the rotation member is seized at the sliding portion and, as a result, there is a problem that the rotation movement of the rotation member is restrained.

If the rotation member or the member with respect to which the rotation member slides is deformed in some manner, a clearance of the contacting sliding portion set in advance is not maintained and, as a result, it may possibly seize in a similar manner.

Though thus seizure of the rotation member does not usually occur, if anything should happen, the engine stops because fuel injection to the engine is terminated, but the engine does not stop simultaneously to seizing (sticking) of the rotation shaft in the injection pump. Although the drive shaft of the injection pump is locked up (seized), the drive force is transmitted from the crank shaft to the timing belt to cause jumping of the teeth of the timing belt. Thus, the phase between the crank shaft and the cam shaft for the intake/discharge valve deviates and the timing of operation between the pistons of the engine and the intake/discharge valve deviates so that they come into collision with each other and, as a result, it may be possible to cause considerable damage to engine. If this should occur, not only the injection pump be repaired but also the engine itself must be repaired.

SUMMARY OF THE INVENTION

An object of the invention is to provide a distributor type fuel injection pump and a power transmission device for transmitting power thereto, in which, if the above mentioned problems occur, the rotation system member of an injection pump is seized, but damage occurs only in the injection pump, so that fear of damage to an engine may be decreased.

To achieve the above mentioned object, the distributor type fuel injection pump according to the present invention comprises a rotation system member rotating by receiving power from an engine and rotatably supported inside of a housing; plungers slid ably provided in radial directions of the rotation system member to vary volume of a compression space formed in the rotation system member; a cam ring provided concentrically around the rotation system member to make the plungers reciprocate in the radial directions upon rotation of the rotation system member; and a control sleeve fitting outside of the rotation system member to control injection quantity by being adjusted in relative position in the axial direction. A frail portion whose strength is relatively weak is provided in the rotation system member, and the frail portion is formed at a position such that a sliding portion of said rotation system member remains on a side of the frail portion opposite to a power supply whereby, when rotation is prevented at the portion of the rotor opposite to the power supply side, the frail portion is broken before rotation of a portion of the rotor on the power supply side of the frail portion is prevented.

A power transmission device for transmitting power to this distributor type fuel injection pump is such that a drive pulley is provided for the rotation system member of the above mentioned distributor type fuel injection pump. This drive pulley and a drive pulley mounted on a crank shaft of the engine are connected by a transmission member to transmit power of the engine to the rotation system member of the distributor type fuel injection pump via the transmission member. As the transmission member, a toothed belt engaging with each drive pulley (a timing belt), gears and so on are used.

Accordingly, in the rotation system member of the injection pump, as a frail portion is formed with the sliding portion remaining on the side of the frail portion opposite the power supply side, when a sliding portion on the side of the frail portion opposite the power supply side is seized during rotation of the rotation system member to bind the rotation, the force binding rotation acts on the rotation system member to prevent transmission of power from the engine, but the frail portion is broken before rotation of the power supply portion of the rotor is prevented, to thereby avoid locking of the rotation system member as a whole. Therefore, in the injection pump, the function of injection of fuel is lost due to damage of the rotation system member, but locking of the rotation system member as a whole is prevented, damage to the transmission member is prevented and damage of the engine is prevented or reduced.

There are many cases in which the rotation system of the injection pump is constituted by a drive shaft transmitting the engine power and a rotor connected to the drive shaft. In these cases, it is preferred that the frail portion comprises a narrowed portion formed in the rotor and formed at a position such that the most part which slide relative to the rotor are on a side of the frail portion opposite the power supply side. Furthermore, it is preferred that the narrowed portion formed in the rotor is constituted by an annular groove formed by cutting on a surface of the rotor, etc..

According to thus construction, the sliding portion of the rotor is formed between a member supporting the rotor and the control sleeve, but as most of the sliding portion of the rotor is provided on the side of the narrowed portion opposite the power supply side, the rotor can be broken at the narrowed portion when seizure occurs at almost any part of the sliding portion, so that there is no case that rotation on the power supply side of the rotor is prevented by seizure of the injection pump.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAIL DESCRIPTION OF THE PREFERRED EMBODIMENT

Figure 1:
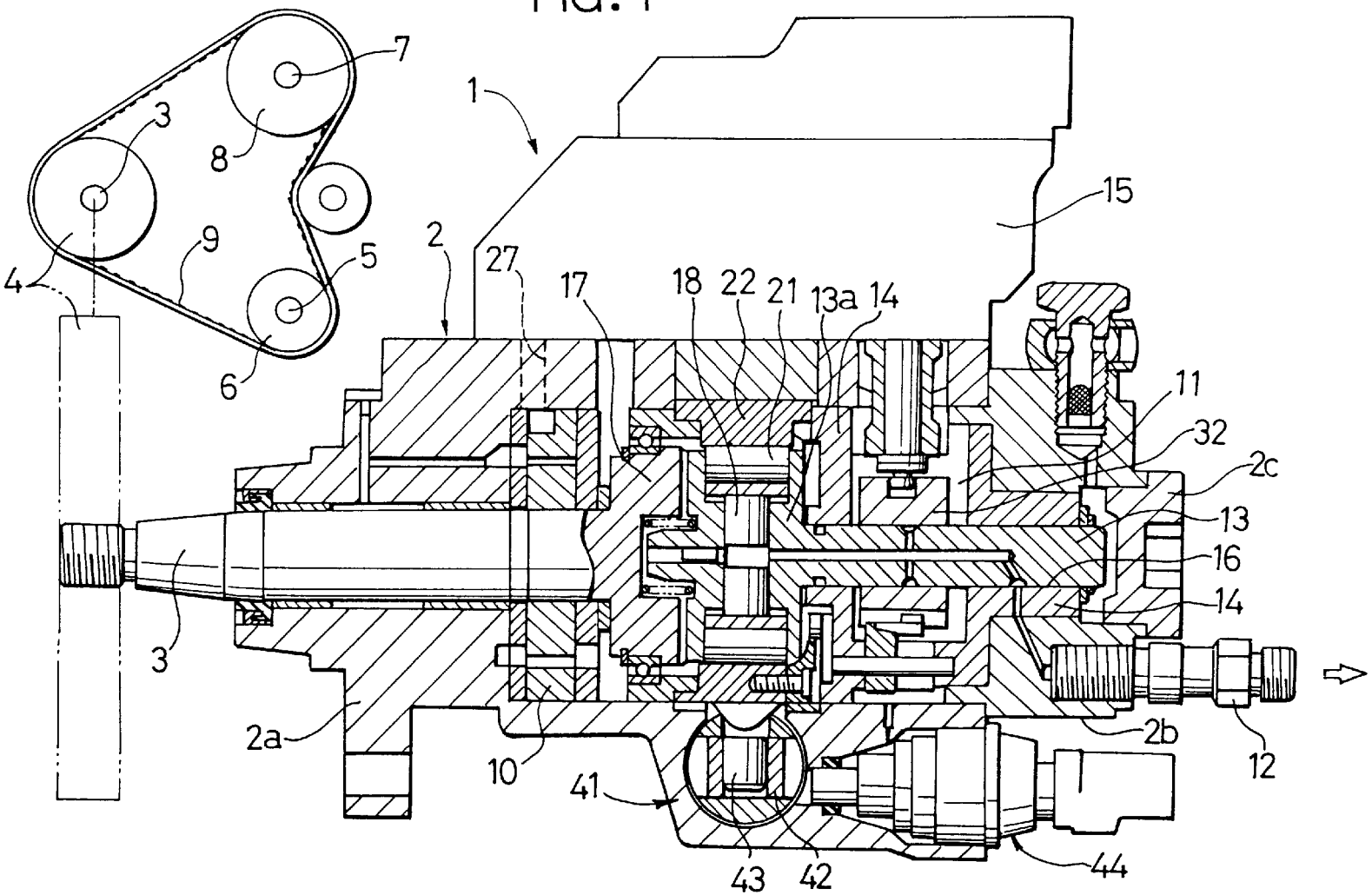
FIG. 1 is a cross-section view of a distributor type fuel injection pump according to the present invention.
Figure 2:
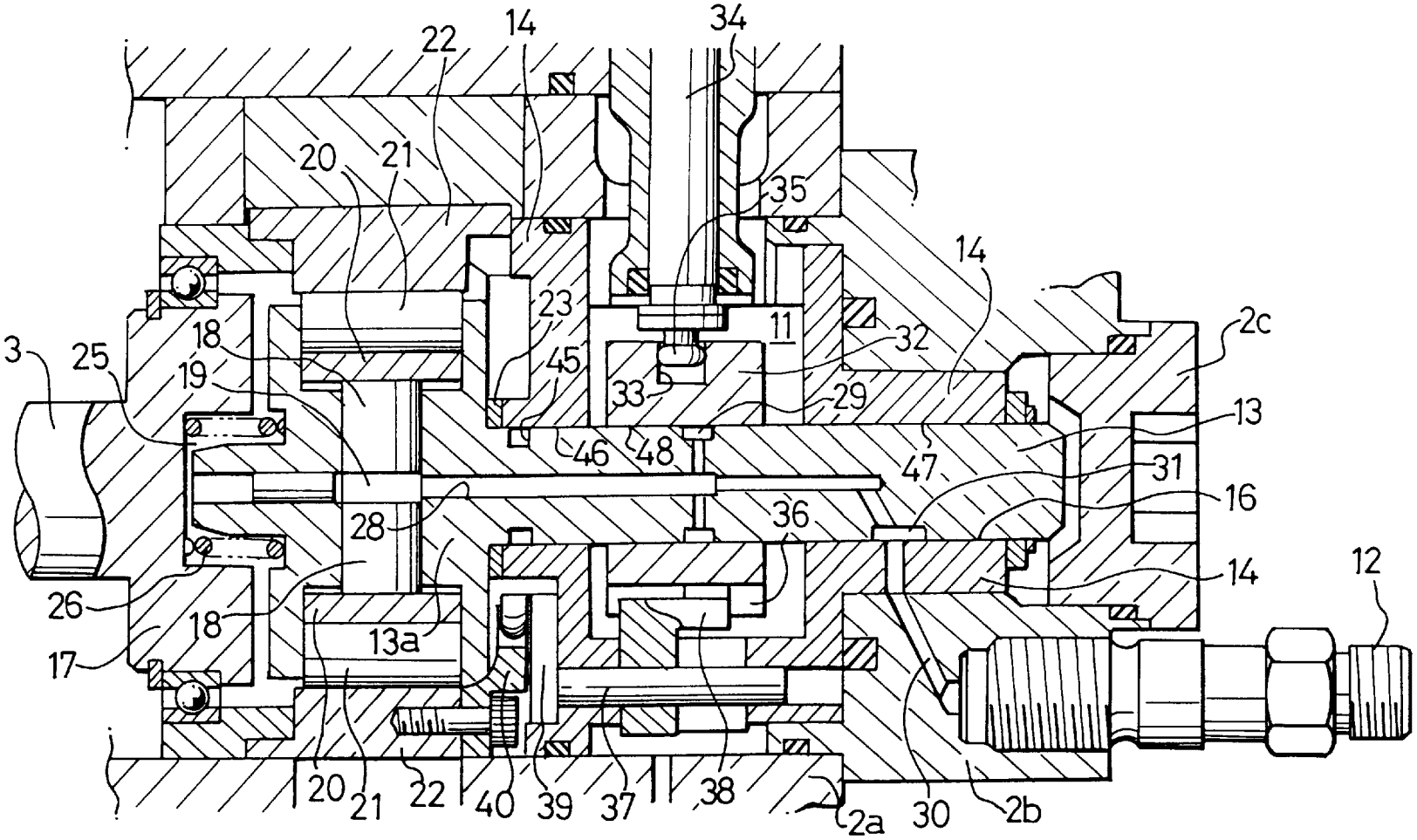
FIG. 2 is an enlarged cross-section view showing a rotor illustrated in FIG. 1 and members around the rotor.

The following is an explanation of the embodiments according to the present invention with reference to the drawings. In FIGS. 1 and 2, an inner cam system distributor type fuel injection pump is shown. In the distributor type fuel injection pump 1, a drive shaft 3 is inserted in a pump housing 2 and a drive pulley 4 is attached at one end of the drive shaft 3 projecting to the outside of the pump housing 2. A power transmission system is constituted such that the drive pulley 4 is connected with a drive pulley 6 attached on a crank shaft 5 of an engine and a drive pulley 8 attached on a cam shaft 7 for intake/discharge valve via a toothed belt 9, and in this system, the toothed belt 9 is given a tension to transmit the power of the engine to the cam shaft 7 for the intake/discharge valve and the drive shaft 3, so that every shaft is rotated while maintaining a specific phase relation.

A feed pump 10 is fitted on the drive shaft 3 of the injection pump 1 inside of the pump housing 2, and fuel supplied into the housing in some pressurized condition is delivered to a fuel chamber 11 by the feed pump 10. The pump housing 2 comprises a first housing member 2*a* in which the drive shaft 3 is inserted, a second housing 2*b* mounted on the first housing member 2*a* and provided with a delivery valve 12, etc., and a third housing member 2*c* closing an opening of the second housing member 2*b* and mounted on an extending line of a rotor 13. The fuel chamber 11 is formed by a space surrounded by a rotor supporting member 14 inserted into and fitted in the second housing member 2*b*, and the fuel chamber 11 is communicated with a governor storage chamber defined by a governor housing 15.

The rotor 13 is supported rotatably and in an oil-tight manner in a through hole 16 formed in the rotor supporting member 14. A base end portion 13*a* of the rotor 13 is connected to the drive shaft 3 via a coupling (a connecting portion) 17 to allow only rotation of the rotor 13 upon rotation of the drive shaft 3. Plungers 18 are inserted slid ably in radial directions at the base portion 13*a* of the rotor 13. Two (or four) plungers 18 is provided at intervals of 180° (or 90°) on the same axial level, a top end of each plunger 18 faces a compression space 19 provided at a center of the base end portion 13*a* of the rotor 13 so as to close and define the space 19, and the plungers 18 contact and slide on an inner surface of a cam ring 22 via a shoe 20 and a roller 21. The cam ring 22 is a ring-shaped member provided concentrically around the rotor 13, and a cam surface having cam surface portions corresponding to the number of cylinders in the engine is formed inside the ring-shaped member such that, when the rotor rotates, each plunger 18 is reciprocated in the radial direction of the rotor 13 simultaneously to vary the volume of the compression space 19.

Namely, if the cam ring is formed for an engine with four cylinders, four convex surface portions are formed at intervals of 90° inside of the cam ring 22. In this case, four plungers 18 are moved into the compression space 19 simultaneously and next moved away from the compression space 19.

A washer 23 is provided between the base end portion 13*a* of the rotor 13 and the rotor supporting member 14 to avoid the rotor 13 contacting and sliding against the rotor supporting member 14 directly, and further, contacting and sliding portions are formed on both sides of the washer 23 to decrease abrasion of the rotor 13. A spring storage chamber 25 is formed in the connecting portion 17 between the base end portion 13*a* of the rotor 13 and the drive shaft 3, and a compressed spring mounted in the spring storage chamber 25 constantly urges the rotor 13 away from the drive shaft 3.

Fuel flown from a fuel intake opening (it is formed in an invisible side of the housing 2 in the figures) into the housing 2 is guided to an intake side of the feed pump 10 via a space formed around the rotor supporting member 14, and a space formed between the cam ring 22 and the rotor 13, surrounding the coupling 17, and then fuel compressed by the feed pump 10 flows to a governor storage chamber via a passage 27 formed in a pump housing 2 and a governor housing 15 installed on the pump housing 2.

Figure 3A:
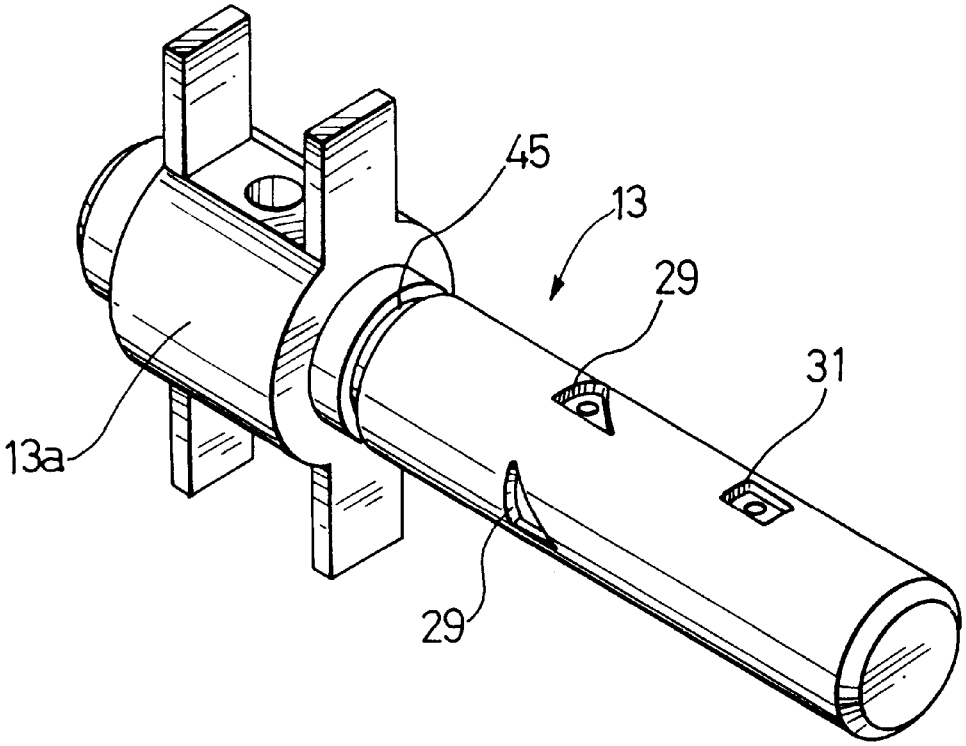
FIGS. 3A and 3B illustrate the rotor used in the distributor type fuel injection pump according to the present invention, FIG. 3A being a perspective view of the rotor, and FIG. 3B being a cross-sectional view of the rotor.
Figure 3B:
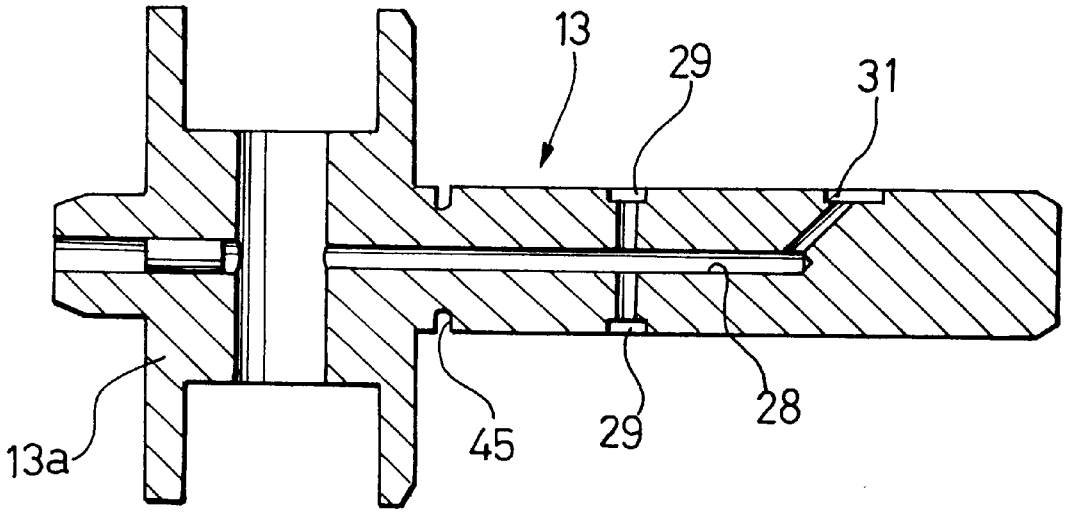

In the rotor 13, as shown in FIGS. 3A and 3B, are formed a longitudinal hole 28 extending in an axial direction of the rotor 13 and communicating with the compression space 19, inflow/outflow ports 29 communicating with the longitudinal hole 28 and opening through an outer surface of the rotor 13, and a distributing port 31 whose one end is connected to the longitudinal hole 28 and whose other end is communicated with fuel delivery passages 30 formed in the rotor supporting member 14 and the second housing member 2*b* interrupted.

The inflow/outflow ports 29 formed in the rotor 13 are formed at regular intervals with a specific phase corresponding to the number of the cylinders of the engine, the inflow/outflow ports 29 being open to the surface of the rotor 13 in the part thereof located at the fuel chamber 11. The openings of the inflow/outflow ports 29 are covered with a control sleeve 32 fitted about the rotor 13 in an oil-tight manner. In the control sleeve 32, a first groove 33 is formed within a range of a specific angle in circumferential direction in an outer surface thereof, and a ball 35 formed at an end of a shaft 34 of an electric governor is engaged in the first groove 33. The ball 35 is mounted on the shaft 34 eccentrically and, when the shaft 34 is rotated by an external signal from the governor, the control sleeve 32 moves in the axial direction of the rotor 13. A through hole communicable with the inflow/outflow ports 29 is formed in the control sleeve 32.

A second groove 36, extending in the axial direction, is formed in the control sleeve 32. An engaging member 38 is secured on a connecting rod 37 rotatably supported on the rotor supporting member 14 and engages in the second groove 36. The connecting rod 37 is engaged with a connecting piece in which an arm portion 39 extending in a radial direction is secured to the cam ring 22, so that the control sleeve 32 is rotated with a specific relation when the cam ring 22 rotates.

Note that the amount of rotation of the cam ring 22 is controlled by a timer device 41, in which a timer piston 42 is contained slid ably in a cylinder mounted in a lower portion of the pump housing 2 and the timer piston 42 is connected to a lever 43 extending from the cam ring 22, so that movement of the timer piston 42 is converted to rotation of the cam ring 22. A high pressure chamber in which fuel in a side of the chamber is introduced is formed at one end of the timer piston 42, and a low pressure chamber communicating with an upstream side of the feed pump is formed at another end of the timer piston 42. A compressed timer spring is stored in the low pressure chamber, the timer piston 42 being constantly urged toward the high pressure chamber by the timer spring, so that the timer piston 42 is held at a position in which spring pressure of the timer spring and fuel pressure in the high pressure chamber are balanced. The amount of rotation of the cam ring 22, that is, a desired advance angle, is determined by adjusting a pressure in the high pressure chamber via a timing control valve (TV) 44.

In this fuel injection pump 1, when the rotor 13 rotates, the inflow/outflow ports 29 corresponding to the number of the cylinders are communicated with the through hole of the control sleeve 32 in turn, and in an intake process in which the plungers 18 move away from a center of the cam ring 22, one of the inflow/outflow ports 29 and the through hole of the control sleeve 32 are aligned with each other, so that fuel in the chamber 11 is inhaled into the compression space 19.

Then, entering into a compression process in which the plungers 18 move to the center of the cam ring 22, communication between the inflow/outflow port 29 and the through hole of the control sleeve 32 is terminated and the distributing port 31 and one of the fuel delivery passages 30 are aligned with each other, so that compressed fuel is delivered to the delivery valve 12 via the fuel delivery passage 30. Note that fuel delivered from the delivery valve 12 is delivered to the injection nozzle via an injection pipe (not shown in the figures) to be injected into the cylinder of the engine from the injection nozzle.

During the compression process, when the through hole of the control sleeve 32 and the next of the inflow/outflow port 29 are communicated with each other, the compressed fuel flows out to the chamber 11, so that delivery to the injection nozzle is stopped to terminate injection. The above processes are repeated in turn, such that four cycles of these precesses occur each one rotation in the above embodiment.

An annular groove 45 is formed in the rotor 13 adjacent the base end portion 13*a* thereof by cutting the circumferential surface of the rotor 13. A first sliding portion 46 and a second sliding portion 47 are defined between the rotor 13 and the rotor supporting member 14 in the above construction, and a third sliding portion 48 is formed between the control sleeve 32 and the rotor 13. Thus, three sliding portions are formed overall. The annular groove 45 is formed in the portion of the first sliding portion 46 nearest the drive shaft. Accordingly, the first, the second and the third portions 46, 47 and 48 are formed on a side of the annular groove 45 opposite to the drive shaft.

The annular groove 45 is provided in order to relatively weaken the strength of the rotor 13 in a part thereof, the annular groove 45 being different from a recess provided in the rotor to polish the sliding surface. The width of the groove 45 or depth of the groove 45 are set such that the rotor is twisted off by the drive torque from the engine when seizure occurs in the sliding portions. The width or the depth of the groove must be set by repeating experimentation in advance so that the rotor 13 is not broken unnecessarily during a normal operation. The position of the annular groove 45 is at the part nearest to the drive shaft in the first sliding portion 46 so that no sliding portion is formed nearer to a drive shaft side than the annular groove and so that the washer 23 between the base end portion 13*a* and the rotor supporting member 14 is not inserted in the annular groove 45.

In the above construction, when the rotor 13 is seized at any one of the sliding portion 46–48 by any cause to prevent from rotation, the rotor 13 and the drive shaft 3 connecting with the rotor 13 are restrained in rotation, so that a large load is given to the timing belt 9 connecting between the drive pulley 4 attached on the drive shaft 3 and the drive pulley 6 of the crank shaft 5 of the engine in a breaking direction. On this occasion, as the engine stops instantly, drive power from the crank shaft 5 which is transmitted to the drive shaft 3 of injection pump though rotation of the rotor 13 is restrained. As a result, the rotor 13 is chewed off at the annular groove 45 by a drive torque given to the drive shaft 3, and a part of the rotor on the drive shaft side of the annular groove 45 is not prevented from rotating in synchronization with the engine once the rotor 13 has been twisted off at the annular groove 45. Accordingly, the toothed belt 9 is prevented from jumping teeth, and thus trouble with the engine which might occur due to such jumping of teeth can be prevented, so that only the injection pump is broken.

Note that construction in which the annular groove 45 is formed in the drive shaft 3 allows the drive shaft to break if anything should happen, but when the plungers 18 are moved during the compression process, a large load in the rotating direction is given to the connecting portion 17 and/or the drive shaft 3, so that it is possible that the portion is broken unnecessarily irrespective of the seizing of the rotor 13. Though it is preferred that, if the annular groove 45 is formed in either the second sliding portion 47 or the third sliding portion 48 of the rotor 13, it is formed in a position thereof nearest to the drive shaft, or that the annular groove 45 be formed in a portion opening the chamber 11 and not in sliding contact with the sliding portions, so that the sliding portion remains in the drive shaft side with respect to the annular groove 45, and so that influence to the power transmission system upon seizing of the rotor is prevented completely. Accordingly, it is preferred that a forming portion of the annular groove 45 is in the rotor 13, and it is further preferred that the forming portion is in the position of the first sliding portion 46 nearest the drive shaft as mentioned above.

As described above, according to the present invention, a frail portion whose strength is relative weak, which is the annular groove in the above embodiment, is provided in a rotation system member, that is the rotor, of the injection pump. The frail portion is formed at a position such that the seized sliding portion is on a side of the frail portion opposite to the power supply side, and thus, when the frail portion is broken during rotation, a part on the power supply side is not prevented from rotating when rotation of the side opposite to the power supply side with respect to the frail portion is prevented, so that when the seizing occurs in the rotation system member of the injection pump if anything should happen, only the injection pump is damaged thereby greatly decreasing damage to the engine.

The rotation system member of the injection pump is constituted with a drive shaft to which the power from the engine is transmitted and the rotor, with the control sleeve fitted thereon, connected to the drive shaft. When the frail portion is constituted by a narrow portion of the rotor, it is easy to process (form) the rotor, so that it is possible to put a fail safe function into practice by utilizing a simple shape of the rotor. Furthermore, almost all of the sliding portions of the rotor are positioned on the side opposite to the power supply side with respect to the narrowed portion, so that the rotor is broken when seizing occurs at any position of the sliding portions and, as a result, it is possible to reinforce protection of the power transmission system.

What is claimed is:

1. A distributor type fuel injection pump for injecting fuel compressed in a compression space to an engine, comprising:

a rotation system member rotating by receiving power from the engine and supported rotatably inside a housing;

plungers provided slid ably in radial directions of said rotation system member to vary volume of a compression space formed in said rotation system member;

a cam ring provided concentrically around said rotation system member to make said plungers reciprocate in the radial directions of the rotation system member upon rotation of said rotation system member; and a control sleeve fitting outside said rotation system member to control injection quantity by being adjusted in relative position in an axial direction;

wherein a frail portion whose strength is relatively weak is provided in said rotation system member, said frail portion is formed in a position such that most of a sliding portion to said rotation system member remains on a side of said frail portion opposite to a power supply side whereby, when rotation of said rotation system member is seized at the sliding portion on the side of the frail portion opposite the power supply side, said rotation system member is broken at said frail portion and rotation of a part on the power supply side is not prevented.

2. A distributor type fuel injection pump according to claim 1, wherein:

said rotation system member is constituted by a drive shaft to which power of the engine is transmitted and a rotor connected to said drive shaft, said control sleeve being fitted outside said rotor, said frail portion is constituted by a narrowed portion formed in said rotor, and said narrowed portion is formed in a position where most of a sliding portion of said rotor is on the side of the narrowed portion to the power supply side.

3. A distributor type fuel injection pump according to claim 2, wherein:

said narrowed portion is an annular groove formed by cutting a surface of said rotor.

4. A distributor type fuel injection pump according to claim 2, wherein:

said plungers are provided in a base end portion of said rotor connecting to said drive shaft, a top end side of the said rotor away from the base end portion is inserted rotatably in a rotor supporting member secured in said housing, a plurality of sliding portions are formed between said rotor and said rotor supporting member, and said frail portion is formed in a part of said rotor nearest to said drive shaft side.

5. A distributor type fuel injection pump according to claim 2, wherein:

said plungers are provided in a base end portion of said rotor connecting said drive shaft, a top end side of said rotor away from the base end portion is inserted rotatably in a rotor supporting member secured in said housing, a washer is interposed between said base end portion and said rotor supporting member, and said frail portion is formed at a position other than where said washer is provided.

6. A distributor type fuel injection pump according to claim 2, wherein:

said rotor has:

a longitudinal hole formed in an axial direction to communicate with said compression space;

inflow/outflow ports communicating with said longitudinal hole and opening at a circumferential surface of said rotor; and a distributing port whose one end is connected to said longitudinal hole and whose other end is interrupted communicated with fuel delivery passages communicating with a delivery valve.

7. A power transmission device for transmitting power of an engine to a distributor type fuel injection pump, wherein:

said distributor type fuel injection pump comprising, a rotation system member rotating by receiving power from the engine and supported rotatably inside a housing, plungers provided slid ably in radial directions of said rotation system member to vary volume of a compression space formed in said rotation system member, a cam ring provided concentrically around said rotation system member to make said plungers reciprocate in the radial directions of the rotation system member upon rotation of said rotation system member, and a control sleeve fitting outside said rotation system member to control injection quantity by being adjusted in relative position in an axial direction, wherein a frail portion whose strength is relatively weak is provided in said rotation system member, said frail portion is formed in a position such that most of a sliding portion of said rotation system member is on a side of said frail portion opposite to a power supply side whereby, when rotation of said rotation system member is seized at the sliding portion on the side of the frail portion opposite to the power supply side, said rotation system member is broken at said frail portion and rotation of a part on the power supply side is prevented; and said power transmission device is constituted by connecting a drive pulley provided in said rotation system member of said distributor type fuel injection pump, a drive pulley installed on a crank shaft of the engine and a drive pulley installed on a cam shaft for intake/discharge valve via a transmission member, so that power of the engine is transmitted to said rotation system member of said distributor type fuel injection pump via said transmission member.

8. A power transmission device according to claim 7, wherein:

said transmission member is a toothed belt engaging to said drive pulleys.

9. A power transmission device according to claim 7, wherein:

said rotation system member is constituted by a drive shaft to which power of the engine is transmitted and a rotor connected to said drive shaft, said control sleeve being fitted outside said rotor, said frail portion is constituted by a narrowed portion formed in said rotor, and said narrowed portion is formed in a position where most of a sliding portion of said rotor is on the side of the narrowed portion opposite to the power supply side.

10. A power transmission device according to claim 9, wherein:

said narrowed portion is an annular groove formed by cutting a surface of said rotor.

11. A power transmission device according to claim 9, wherein:

said plungers are provided in a base end portion of said rotor connecting to said drive shaft, a top end side of said rotor away from the base end portion is inserted rotatably in a rotor supporting member secured in said housing, a plurality of sliding portions are formed between said rotor and said rotor supporting member, and said frail portion is formed in a part of said rotor nearest to said drive shaft in said sliding portion.

12. A power transmission device according to claim 9, wherein:

said plungers are provided in a base end portion of said rotor connecting said drive shaft, a top end side of said rotor away from the base end portion is inserted rotatably in a rotor supporting member secured in said housing, a washer is interposed between said base end portion and said rotor supporting member, and said frail portion is formed at a position other than where said washer is provided.

13. A power transmission device according to claim 9, wherein:

said rotor has:

a longitudinal hole formed in an axial direction to communicate with said compression space;

inflow/outflow ports communicating with said longitudinal hole and opening at a circumferential surface of said rotor; and a distributing port whose one end is connected to said longitudinal hole and whose other end is interrupted communicated with fuel delivery passages communicating with a delivery valve.

* * * * *